US007444818B1

(12) United States Patent
Brostmeyer

(10) Patent No.: US 7,444,818 B1
(45) Date of Patent: Nov. 4, 2008

(54) BATCH FIRED HEAT RESERVOIRS

(75) Inventor: Joseph Brostmeyer, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 434 days.

(21) Appl. No.: 11/286,953

(22) Filed: Nov. 23, 2005

(51) Int. Cl.
*F01K 25/02* (2006.01)

(52) U.S. Cl. ..... 60/682; 60/683

(58) Field of Classification Search ..... 60/682–683
See application file for complete search history.

(56) References Cited

U.S. PATENT DOCUMENTS 2,478,851 A * 8/1949 Traupel ..... 60/39.17
4,275,562 A * 6/1981 Fejer ..... 60/648
4,326,382 A * 4/1982 Baardson ..... 60/655
4,475,343 A * 10/1984 Dibelius et al. ..... 60/648
4,727,930 A * 3/1988 Bruckner et al. ..... 165/111
6,629,413 B1 * 10/2003 Wendt et al. ..... 60/655

* cited by examiner

*Primary Examiner*—Hoang M Nguyen
(74) *Attorney, Agent, or Firm*—John Ryznic

(57) ABSTRACT

A power plant that burns a dirty fuel like coal to produce a hot gas stream, and directs the hot gas stream into a turbine to produce power. Located between the combustor and the turbine is at least two heat reservoirs that operate in parallel. When a first heat reservoir is being supplied with hot gas stream from the combustor to collect heat therein, the second and parallel heat reservoir is discharging its stored heat into a hot gas stream that leads into the turbine to produce power. When the heat reservoir delivering the hot gas stream to the turbine is low, the gas flow paths are switched such that the heat reservoir with the low heat storage in charged while the near fully charged heat reservoir then delivers heat to drive the turbine. The heat reservoirs contain a series of heat collectors in which the melting temperature of the heat collector in the upstream direction of the hot gas flow from the combustor is higher than the subsequent heat collectors, the melting temperature of the most downstream collector being the lowest.

20 Claims, 4 Drawing Sheets

BATCH FIRED HEAT RESERVOIRS

BACKGROUND OF THE INVENTION

1. Field of the Invention

The present invention relates to a gas turbine driven power plant, and more specifically to one that burns a dirty fuel like coal.

2. Description of the Related Art Including Information Disclosed Under 37 CFR 1.97 and 1.98

A gas turbine engine is a very efficient converter of fuel to energy, and is typically powered by natural gas or a liquid fuel. Coal burning power plants burn coal, the coal being a very cheap source of energy but also contains residue from the combustion process that would damage a turbine if used in the gas turbine power plant. Gas turbine power plants in the past have used heat from burning coal to heat the gas supplied to the turbine, but through a heat exchanger such that the residue from burning coal does not enter the turbine. This heat exchanger is not very efficient in transferring heat, and the maximum operating temperature is limited to what the heat exchanger materials can withstand. The efficiency of a gas turbine increases as the temperature of the hot gas stream increases. Coal can burn to produce a very hot gas stream. However, modern day materials used to make heat exchangers cannot withstand this high temperature. Oil based fuels are burned for use in driving gas turbines, but the cost of oil based fuels have increased in recent years. Coal is a very abundant and relatively cheap fuel.

It is therefore an object of the present invention to provide for a power plant that makes use of the very high energy conversion of a gas turbine with the relatively cheap and abundant use of coal as the heat producing fuel.

It is another object of the present invention to make use of a dirty fuel like coal that can burn at a very high temperature, and use the heated gas in a gas turbine for producing power.

BRIEF SUMMARY OF THE INVENTION

The present invention allows for a gas turbine power plant to be supplied with heat generated from burning of coal without using a heat exchanger. The present invention makes use of two heat reservoirs arranged in parallel. One heat reservoir absorbs heat from the coal burning process while the other heat reservoir gives off its stored heat to the gas turbine system to power the turbine. When the one heat reservoir has stored enough heat from the burning coal, it is then used to supply the heat for the gas turbine system while the other heat reservoir is recharged at the same time. This way, the turbine is operated continuously and one of the heat reservoirs is always receiving heat from the coal burning process. Also, a higher gas stream temperature can be supplied to the turbine than would be available through a conventional heat exchanger. Higher power plant efficiency can be achieved using a low price source of energy (coal).

DETAILED DESCRIPTION OF THE INVENTION

Figure 1:
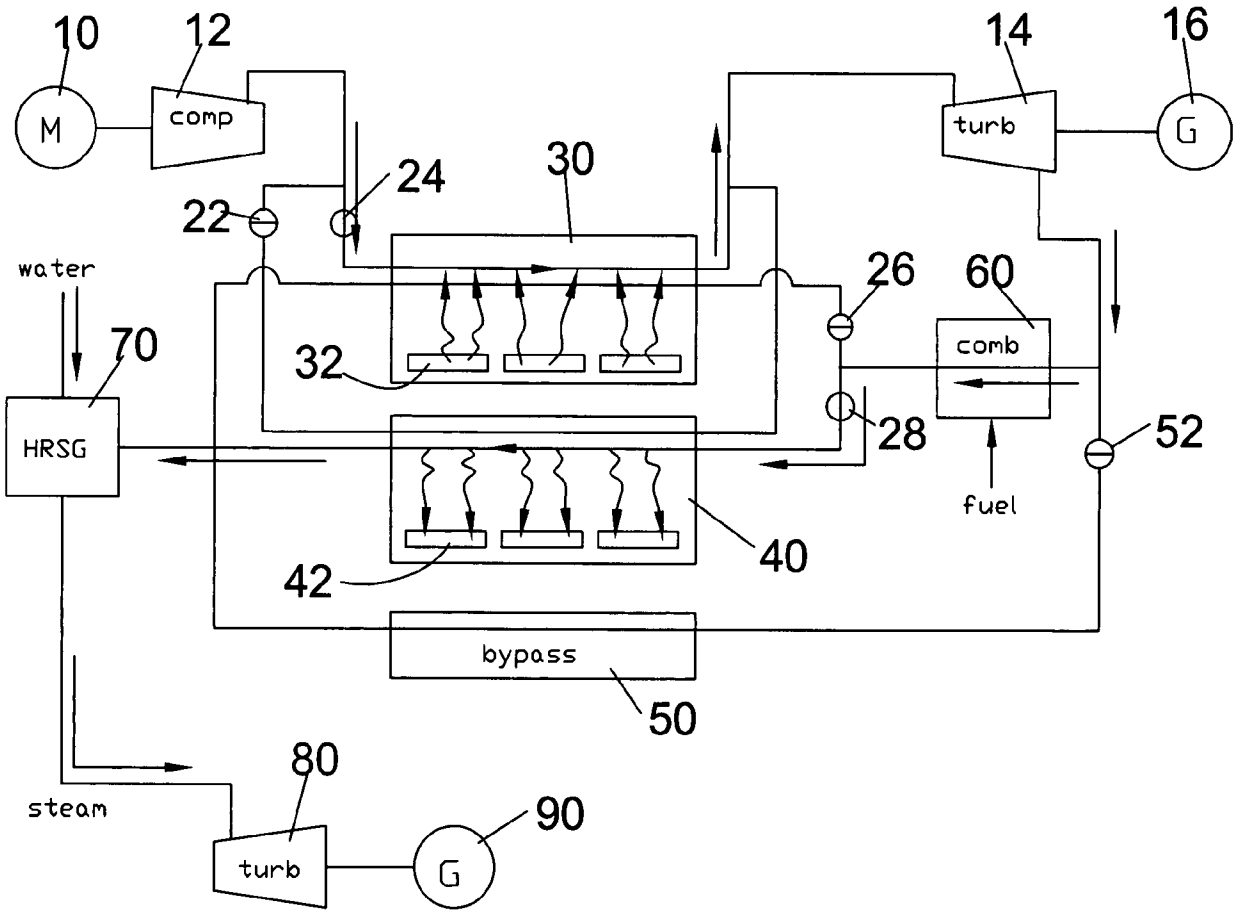
FIG. 1 shows a schematic diagram of a turbine being supplied with heat from a first batch fired heat exchanger while a second and parallel batch fired heat exchanger is supplied with heat from a combustion process.

FIG. 1 shows the power plant system of the present invention. A a gas turbine system is made up of a motor 10, a compressor 12 driven by the motor 10, a turbine 14, and a generator 16 that is driven by the turbine 14. Two batch fired heat reservoirs 30 and 40 are located parallel to one another. The first heat reservoir 30 contains a number of heat collectors 32 that are made of a solid, a liquid, or a phase change material. Heat reservoir 30 is a large open container filled with heat collectors 32. The heat reservoir 30 is capable of supporting high internal pressures and high temperatures required for normal operation of the turbine 14. Heat reservoir 30 is of such size that the number of heat collectors is enough to store the amount of energy needed to heat the gas that is eventually delivered to the turbine 14. The gas passing from the compressor 12 to the turbine 14 or passing from the combustor 60 passes within the container and over the heat collectors 32. Thus, there is no need for the wall of heat collectors 32 to be thick and strong to withstand high pressures that would be required if a heat exchanger was used. The inside walls of the heat reservoir 30 can be lined with firebrick or another material that can withstand the high heat from the coal burning combustor. The outside wall of the heat reservoir 30 can also be reinforced in order to withstand the high pressure of the gas passing through and into the turbine 14. In one embodiment of the present invention, the reservoir 30 is a large steel pipe having a wall thickness capable of withstanding the high pressure delivered by the compressor 12.

A second heat reservoir 40 is identical to the first heat reservoir 30, and also has a number of heat collectors 42. A combustion chamber 60 is supplied with a fuel such as coal and a gas from the turbine 14. A bypass 50 with a bypass control valve 52 is also located in parallel to the first and second heat reservoirs 30 and 40. In order to make use of the leftover heat from the burning coal that is not stored in the heat reservoirs, a heat recovery steam generator (HRSG) 70 is used to turn water into steam. The steam is delivered to a second turbine 80, which drives a second generator 90 to produce power and therefore increase the overall efficiency of the power plant.

When the first heat reservoir 30 is near its heat storage maximum capacity, gas from the compressor 12 is delivered to the first heat reservoir 30 by opening valve 24 and closing a valve 22. The gas from the compressor 12 is passed through the first heat reservoir 30 and passes through and around the heat collectors 32, with the gas absorbing heat from such passage. The heated gas is then delivered to the turbine 14 to drive the generator 16. While this is occurring, the heated gas from the combustor 60 that is burning the fuel is delivered to the second heat reservoir 40 to recharge the heat collectors 42 therein. Valve 26 is closed and valve 28 is opened to deliver the heated gas from the combustor 60 to the second heat reservoir 40. Gas from the second heat reservoir 40 is delivered to the HRSG 70 to convert the water into steam and drive the second turbine 80.

Figure 4:
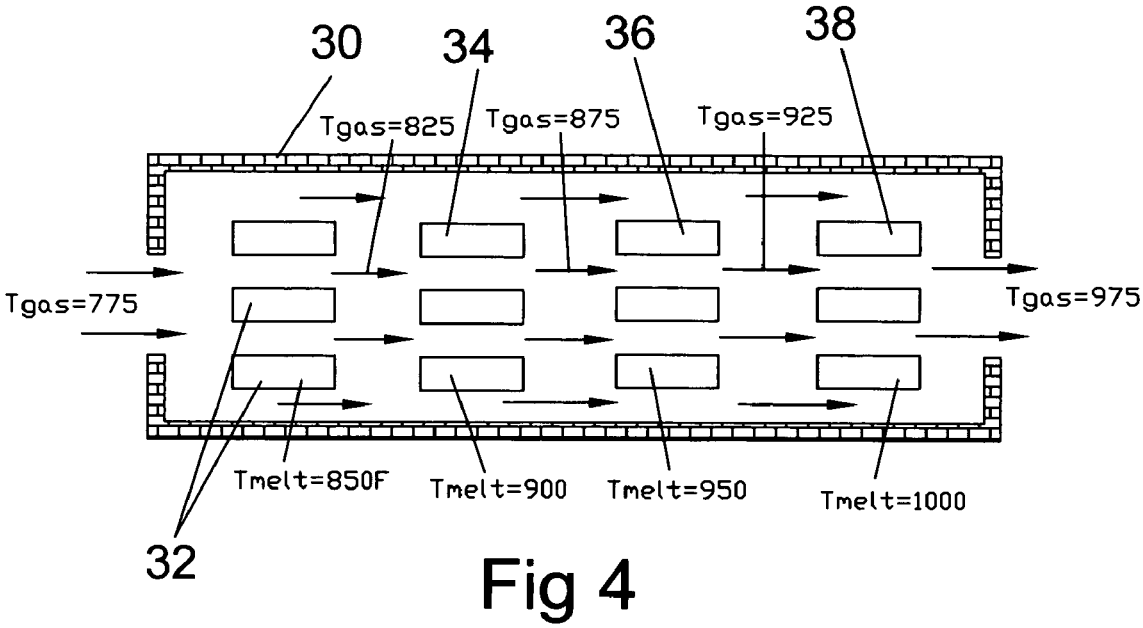
FIG. 4 shows a heat reservoir used the power plant system of FIGS. 1-3 where the heat collectors are arranged in series along the reservoir and have progressively increasing melting temperatures.

When the first heat reservoir 30 has given off enough heat (or, when the second heat reservoir 40 has been charged with enough heat), valve 24 is closed and valve 22 is opened such that gas from the compressor 12 is delivered to the second heat reservoir 40 as shown in FIG. 4. At the same time that valves 22 and 24 are switched, valve 26 is opened and valve 28 is closed such that heated gas from the combustor 60 is delivered to the first heat reservoir 30, and thus recharging the first heat reservoir 30. The compressor gas passing through the second heat reservoir 40 is heated by the gas passing around and through the heat collectors 42 as described above, and the gas is then delivered to the turbine 14 to continue driving the generator 16. When the second heat reservoir 40 has given off enough heat, the system reverts back to that shown in FIG. 1 and the discharged heat reservoir is recharged again as described above. Under this parallel batch heat reservoir system, the particulate material from the burning coal can be used in a gas turbine engine without the particulate material entering the turbine.

Figure 2:
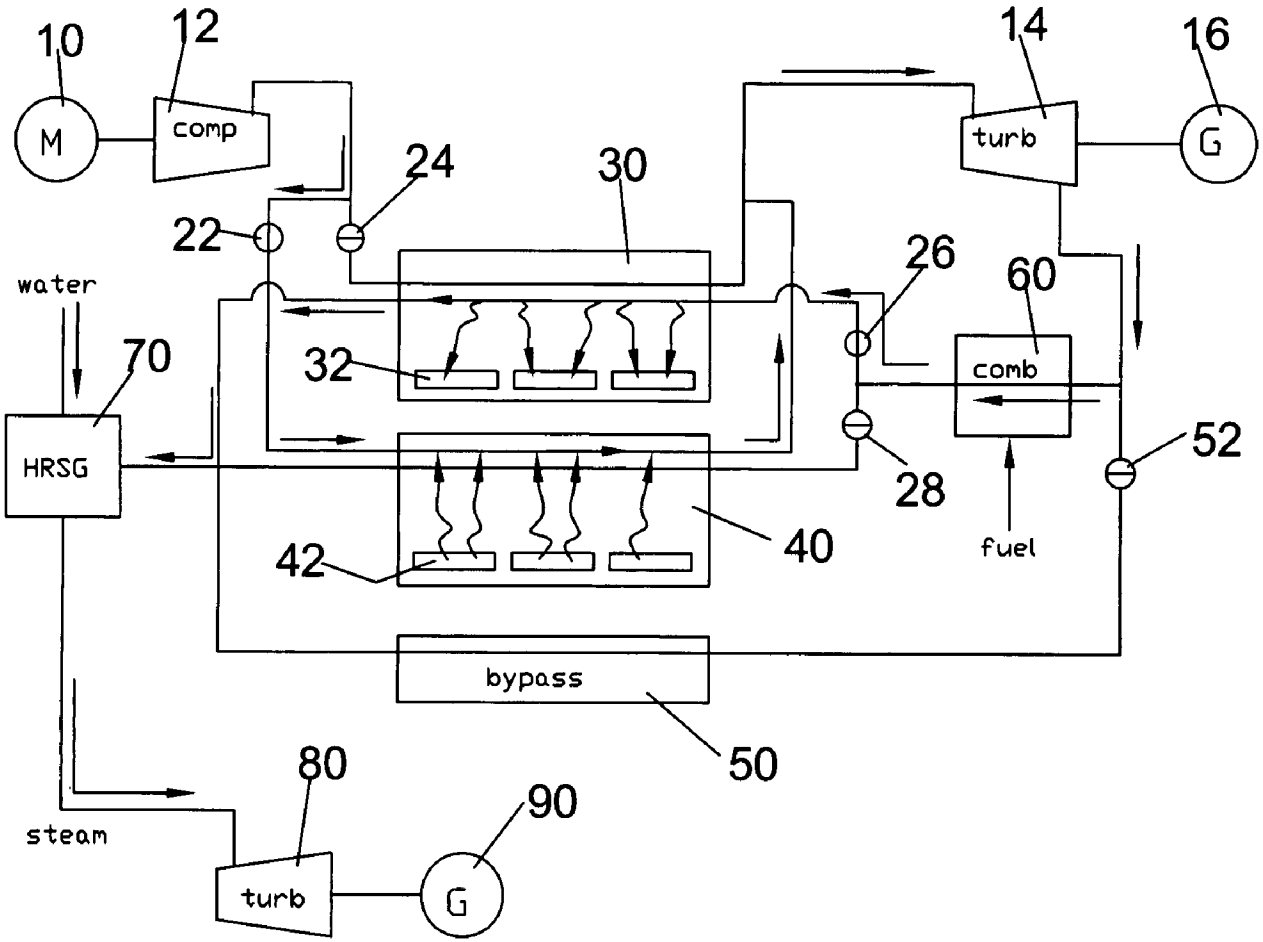
FIG. 2 shows a schematic diagram of the turbine being supplied with heat from the second batch fired heat exchanger while the first batch fired heat exchanger is re-supplied with heat from the combustion process.
Figure 3:
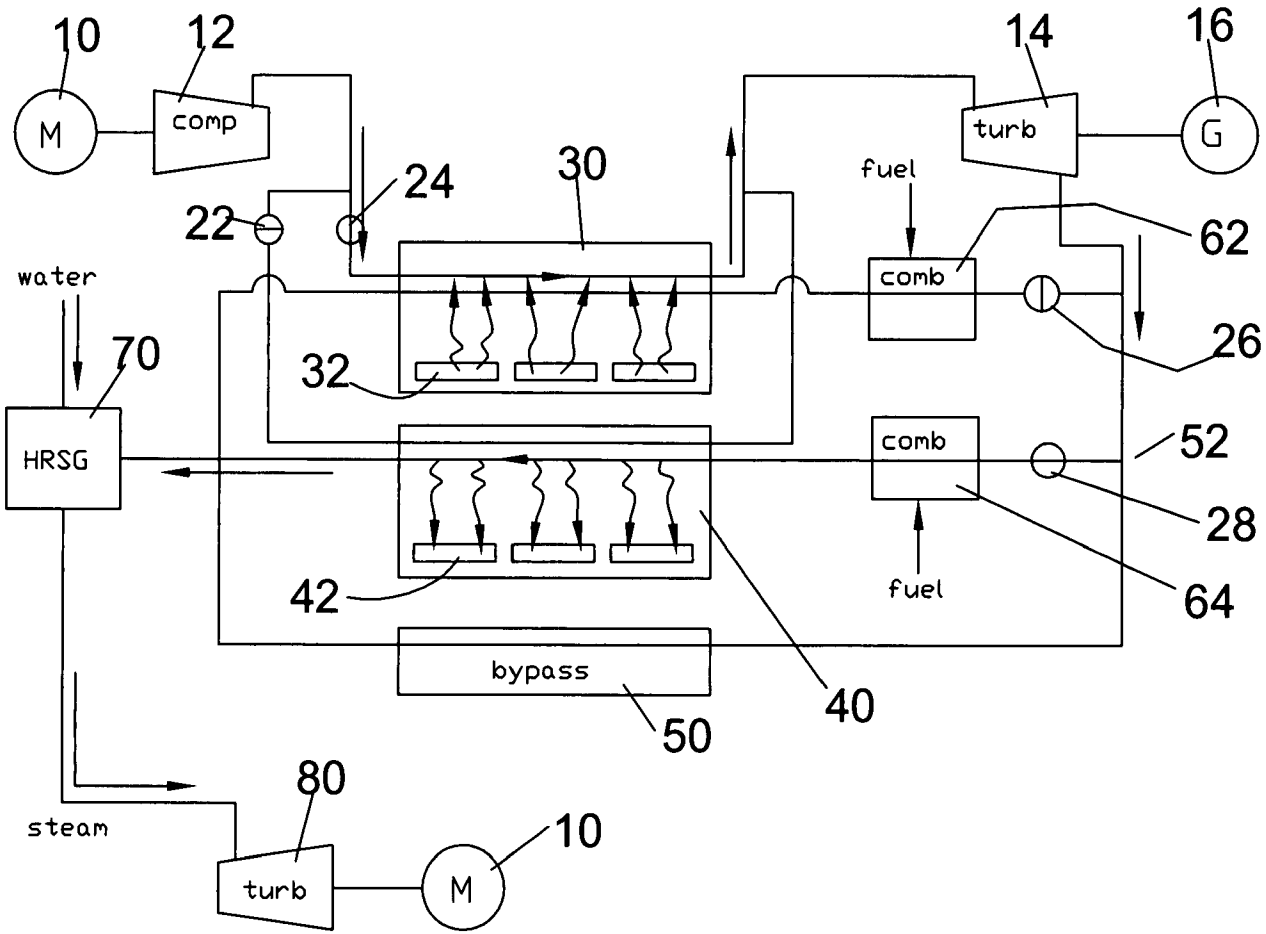
FIG. 3 shows a schematic diagram of a second embodiment of the power plant system where two combustors are used instead of a single combustor and the second turbine is used to drive the compressor of the first turbine system.

FIG. 3 shows a second embodiment of the invention. Instead of using one combustor 60 as in FIGS. 1 and 2, this embodiment uses a first combustor 62 in the line to deliver heated gas to the first heat reservoir 30 and a second combustor 64 that delivers heated gas to the second heat reservoir 40. Valves 26 and 28 are located in the respective line leading into the two combustors and operate as described with respect to FIGS. 1 and 2 in the first embodiment. Also in this FIG. 3 embodiment, the second turbine 80 is mechanically connected to the motor 10 used to drive the compressor 12 instead of a second generator as shown in FIG. 1.

FIG. 4 shows details of the heat collector 30. The inner walls of the collector 30 are made of a heat resistant material capable of withstanding the hot gas temperature from the combustor 60. The heat collectors (32,34,36,38) are arranged in series such that the downstream collector has a higher melting temperature than does the upstream collector. In the embodiment of FIG. 4, collectors 32 have a melting temperature of around 850 degrees F., collectors 34 have a melting temperature of around 900 degrees F., collectors 36 melt at about 950 F, and collectors 38 melt at about 1000 F. each collector can be a tube closed at both ends and filled with a phase change material. The tube would be made of a material that has strength at the melting temperature of the filler material. The collectors are arranged in this order due to the direction in which the hot gas from the combustor flows—in the opposite direction to the flow from compressor 12 to turbine 14. This way, the collectors 38 are exposed to the highest gas temperature from the combustor 60, which cools the gas flowing through the heat reservoir. The next collector 36 is then heated from the combustor gas flow that happens to be lower in temperature due to a heat transfer effect from the combustor gas flow to the collectors 38.

The power plant system shown in FIGS. 1-3 can use two or more heat reservoirs. For example, when four heat reservoirs are used, two can be used to receive heat from the combustor while the other two are used to deliver heat to the turbine. Some heat reservoirs absorb heat while others deliver heat to the compressor 12 and turbine 14 gas flow.

I claim the following:

1. A power plant for producing power from burning of a fuel, the power plant comprising:

a combustor for burning a fuel to produce a hot gas stream;

a gas turbine driven by a hot gas stream to produce power;

a first heat reservoir to capture and store heat from the gas stream from the combustor;

a second heat reservoir to capture and store heat from the gas stream from the combustor, the second heat reservoir being in parallel to the first heat reservoir; and, valve means to direct the hot gas stream from the combustor into one of the heat reservoirs while delivering the hot gas stream from the other heat reservoir to the turbine, and the two heat reservoirs alternate supplying heat to the gas turbine.

2. The power plant of claim 1, and further comprising:

a heat recovery steam generator located downstream in the hot gas flow path from the two heat reservoirs to convert left over hot gas from the respective heat reservoir into steam for production of additional power.

3. The power plant of claim 1, and further comprising:

a compressor to supply a high pressure gas to the heat reservoirs and into the turbine to produce power from the heat stored in the respective heat reservoir.

4. The power plant of claim 3, and further comprising:

the hot gas path through the heat reservoir from the combustor is in an opposite direction from the hot gas path through the heat reservoir from the compressor into the turbine.

5. The power plant of claim 1, and further comprising:

a second combustor for burning a fuel, where the first combustor is associated with the first heat reservoir and the second combustor is associated with the second heat reservoir.

6. The power plant of claim 5, and further comprising:

a heat recovery steam generator located downstream in the hot gas flow path from the two heat reservoirs to convert left over hot gas from the respective heat reservoir into steam for production of additional power.

7. The power plant of claim 5, and further comprising:

a compressor to supply a high pressure gas to the heat reservoirs and into the turbine to produce power from the heat stored in the respective heat reservoir.

8. The power plant of claim 7, and further comprising:

the hot gas path through the heat reservoir from the combustor is in an opposite direction from the hot gas path through the heat reservoir from the compressor into the turbine.

9. The power plant of claim 1, and further comprising:

each heat reservoir having a plurality of heat collectors arranged in series, where a heat collector located in an upstream direction of the hot gas flow path from the combustor has a high melting temperature than the heat collector located in a downstream direction.

10. The power plant of claim 1, and further comprising:

each heat reservoir is capable of containing a high temperature gas stream for use in a gas turbine.

11. The power plant of claim 10, and further comprising:

each heat reservoir is formed of a large tubular conduit.

12. A process for producing power from burning a fuel in a combustor and driving a turbine from a hot gas stream, the process comprising the steps of:

passing a hot gas stream from the combustor into a first heat reservoir such that heat is stored within the first heat reservoir for use later;

at the same time, passing a compressed gas from a compressor through a second heat reservoir into the turbine to produce power; and, the two heat reservoirs alternating the supply of heat to the turbine.

13. The process for producing power of claim 12, and further comprising the step of:

after a predetermined condition in one or more of the heat reservoirs, switching over the hot gas path from the combustor into the other heat reservoir, and switching over the compressed gas flow from the compressor to the turbine into the other heat reservoir.

14. The process for producing power of claim 12, and further comprising the step of:

passing the hot gas flow from the combustor through the heat reservoir in one direction while passing the hot gas flow to the turbine in an opposite direction.

15. The process for producing power of claim 12, and further comprising the step of:

burning a dirty fuel in the combustor.

16. The process for producing power of claim 12, and further comprising the step of:

providing a series of heat collectors in each of the heat reservoirs where the melting point of a heat collector in an upstream direction of the hot gas flow from the combustor is higher than a heat collector located downstream thereof.

17. The process for producing power of claim 12, and further comprising the step of:

providing for a second combustor, the second combustor being associated with the second heat reservoir while the first combustor is associated with the first combustor.

18. The process for producing power of claim 12, and further comprising the step of:

providing for control valve means to switch over the hot gas flow through the heat reservoirs from the combustor and the compressor.

19. The process for producing power of claim 13, and further comprising the step of:

providing for the predetermined condition to be when the heat reservoir is about fully loaded with heat from the combustor.

20. The process for producing power of claim 13, and further comprising the step of:

providing for the predetermined condition to be when the heat reservoir is about fully discharged with heat to the turbine.

* * * * *